US006952001B2

(12) United States Patent
McKendree et al.

(10) Patent No.: US 6,952,001 B2
(45) Date of Patent: Oct. 4, 2005

(54) INTEGRITY BOUND SITUATIONAL AWARENESS AND WEAPON TARGETING

(75) Inventors: Thomas L. McKendree, Huntington Beach, CA (US); Hans L. Habereder, Orange, CA (US); Donald R. Ormand, Coto De Caza, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/444,936

(22) Filed: May 23, 2003

(65) Prior Publication Data

US 2004/0233097 A1 Nov. 25, 2004

(51) Int. Cl.[7] ..... G01S 13/88; G01S 15/88; G01S 17/88

(52) U.S. Cl. ..... 244/3.1; 342/52; 342/53; 342/54; 342/55; 342/61; 342/62; 342/63; 367/87; 356/4.01; 382/100; 89/1.11

(58) Field of Search ..... 356/4.01–5.15; 367/87–116; 342/52–58, 60–68; 382/100, 154; 89/1.11; 244/3.1–3.3, 158 R

(56) References Cited

U.S. PATENT DOCUMENTS 2,399,426 A * 4/1946 Bradley ..... 342/67
3,169,727 A * 2/1965 Schroader et al. ..... 244/3.13
4,093,153 A * 6/1978 Bardash et al. ..... 244/3.14
5,785,279 A * 7/1998 Gregory ..... 244/158 R
6,142,411 A * 11/2000 Cobleigh

FOREIGN PATENT DOCUMENTS

EP 0 583 972 A1 * 2/1994
GB 2 211 371 A * 10/1987

OTHER PUBLICATIONS

"Cheyenne Mountain Complex"; no author given; copyrighted in the year 2000; posted at globalsecurity.org.*
"NORAD"; no author given; Department of National Defence of the Givernment of Canada; posted at www.dnd.ca, no date given.*
"Cheyenne Mountain and the NORAD Complex"; no author given; posted at abovetopsecret.com, no date given.*
Dr. George Lindsey, "Canada, NORAD and National Missile Defence"; in the publication "National Network News," (vol. 8, No. 2; Summer 2001); posted at www.sfu.edu.*
"NORAD Air Defense Overview"; no author given; posted at www.npac.syr.edu, no date given.*
PCT/US2004/015725 International Search Report.

* cited by examiner

*Primary Examiner*—Bernarr E. Gregory
(74) *Attorney, Agent, or Firm*—Daly, Crowley, Mofford & Durkee, LLP

(57) ABSTRACT

A system and method of providing situational awareness and weapon targeting is presented. The method includes determining the location of one or more enemy sites and one or more friendly sites. A "Do Not Engage" (DNE) zone is determined around each of the friendly sites and an "Allowable Engagement" (AE) zone is established around each of the enemy sites, wherein none of the AE zones overlap any of the DNE zones. An engagement plan is then determined based on the AE zones and integrity bounds on candidate munitions. The system includes a processing and communications network and a sensor element in communication with the processing and communications network. The system also includes a command control element in communication with the processing and communications network and an operating elements section in communication with the processing and communications network.

30 Claims, 6 Drawing Sheets

INTEGRITY BOUND SITUATIONAL AWARENESS AND WEAPON TARGETING

CROSS REAERENCE TO RELATED APPLICATIONS

Not Applicable.

STATEMENT REGARDING AEDERALLY SPONSORED RESEARCH

Not Applicable.

Field of the Invention

The present invention relates generally to military situational awareness and weapon targeting, and more specifically, to a system for use in military situational awareness and weapon targeting which uses integrity bounds to reduce unintended engagement of friendly troops and sites.

Background of the Invention

Modern warfare often involves enemy troops located close to civilian population and to friendly troops. While it is desirable to engage the enemy troops and enemy sites, care must be used to minimize or eliminate unintentional engagement of friendly troops and/or collateral damage.

In modern warfare the targeting of enemy sites is typically focused on increasing the probability of munitions hitting the desired target, typically with means to improve overall weapon accuracy. Certain countries or groups of people place air defense systems and other military significant systems near buildings such as hospitals, schools or places of religious worship (e.g. churches, temples or mosques) in the hope that an attempted targeting of the military significant systems will be tempered by the desire not to hurt civilians in the hospitals, schools or places of religious worship or to harm the buildings themselves.

One example of a situational awareness system is known as the Common Relevant Operational Picture (CROP). The CROP system allows military planners, inter-government agencies and joint war fighting commanders to review intelligence on their adversary, chart and map troop movements, gather information on an extensive database of knowledge and scenarios and also get the information to the troops.

The CROP system comprises a network of personal computers (PCs) containing a suite of software specifically developed for use by the military and the Department of Defense. The CROP system provides personnel with near real-time situational awareness of the adversary, along with their own forces in a battle space. The system provides to the user the ability to see the locations of troops and equipment; air, land and sea-based; represented by color-coded icons, through a series of virtual maps. By clicking on an icon, which may represent friendly forces or adversaries, the user has the ability to pull up relevant information on the particular piece of equipment or formation of troops.

An example of a weapon targeting system is known as the advanced field artillery tactical data system (AFATDS). AFATDS is a totally integrated fire support command and control system. The system processes fire mission and other related information to coordinate and optimize the use of all fire support assets, including mortars, field artillery, cannon, missile, attack helicopters, air support, and naval gunfire.

Through the use of distributed processing capabilities, fire missions flow through the fire support chain during which target attack criteria is matched to the most effective weapon systems available at the lowest echelon. The automation provided by AFATDS enhances the maneuver commander's ability to defeat an enemy by providing the right mix of firing platforms and munitions for engaging enemy targets based on the commander's guidance and priorities. AFATDS also expands the fire support commander's ability to control assets and allocate resources.

AFATDS automates and facilitates fire support planning and current operations. During battle, AFATDS provides up-to-date battlefield information, target analysis, and unit status, while coordinating target damage assessment and sensor operations. Integrating all fire support systems via a distributed processing system provides a greater degree of tactical mobility for fire support units and allows missions to be planned and completed in less time. AFATDS also meets field artillery needs by managing critical resources; supporting personnel assignments; collecting and forwarding intelligence information; and controlling supply, maintenance, and other logistical functions.

Present day munitions used in warfare are increasingly Precision Guided Munitions (PGMs). A "PGM" is a munition with sensors that allow it to know where it is and actuators that allow the munition to guide itself towards an intended target. The PGMs guidance system provides a generally accurate target area for the munitions to strike. These munitions target an aim point. The aim point has an area around it referred to as the Circular Error Probable (CEP). The CEP defines an area about an aim point for a munition wherein approximately fifty percent of the munitions aimed at the aim point of the target will strike. While fifty percent of the munitions will strike within the CEP area, the remaining fifty percent will strike outside the CEP area, in some cases potentially very far away. It is munitions that strike away from the intended target that result in unintentional engagement of friendly troops or friendly sites or provide collateral damage to civilians and civilian structures.

One system used to provide guidance of a PGM is known as a Laser Guidance System (LGS) used with Laser Guided Bombs (LGBs). In use, a LGB maintains a flight path established by the delivery aircraft. The LGB attempts to align itself with a target that is illuminated by a laser. The laser may be located on the delivery aircraft, on another aircraft or on the ground. When alignment occurs between the LGB and the laser, the reflected laser energy is received by a detector of the LGB and is used to center the LGB flight path on the target.

Another type of PGM is known as an Inertial Guided Munition (IGM). The IGM utilizes an inertial guidance system (IGS) to guide the munition to the intended target. This IGS uses a gyroscope and accelerometer to maintain the predetermined course to the target.

Still another type of PGM is referred to as Seeker Guided Munitions (SGMs). The SGMs attempt to determine a target with either a television or an imaging infrared seeker and a data link. The seeker subsystem of the SGM provides the launch aircraft with a visual presentation of the target as seen from the munition. During munition flight, this presentation is transmitted by the data-link system to the aircraft cockpit monitor. The SGM can be either locked onto the target before or after launch for automatic munition guidance. As the target comes into view, the SGM locks onto the target.

Another navigation system used for PGMs is known as a Global Positioning System (GPS). GPS is well known to those in the aviation field for guiding aircraft. GPS is a satellite navigation system that provides coded satellite signals that are processed by a GPS receiver and enable the receiver to determine position, velocity and time. Generally four satellite signals are used to compute position in three dimensions and a time offset in the receiver clock. A GPS satellite navigation system has three segments: a space segment, a control segment and a user segment.

The GPS space segment is comprised of a group of GPS satellites, known as the GPS Operations Constellation. A total of 24 satellites (plus spares) comprise the constellation, with the orbit altitude of each satellite selected such that the satellites repeat the same ground track and configuration over any point each 24 hours. There are six orbital planes with four satellites in each plane. The planes are equally spaced apart (60 degrees between each plane). The constellation provides between five and eight satellites available from any point on the earth, at any one time.

The GPS control segment comprises a system of tracking stations located around the world. These stations measure signals from the GPS satellites and incorporate these signals into orbital models for each satellite. The models compute precise orbital data (ephemeris) and clock corrections for each satellite. A master control station uploads the ephemeris data and clock data to the satellites. The satellites then send subsets of the orbital ephemeris data to GPS receivers via radio signals.

The GPS user segment comprises the GPS receivers. GPS receivers convert the satellite signals into position, velocity and time estimates. Four satellites are required to compute the X, Y, Z positions and the time. Position in the X, Y and Z dimensions are converted within the receiver to geodetic latitude, longitude and height. Velocity is computed from change in position over time and the satellite Doppler frequencies. Time is computed in satellite time and GPS time. Satellite time is maintained by each satellite. Each satellite contains four atomic clocks that are monitored by the ground control stations and maintained to within one millisecond of GPS time.

Each satellite transmits two microwave carrier signals. The first carrier signal carries the navigation message and code signals. The second carrier signal is used to measure the ionospheric delay by Precise Positioning Service (PPS) equipped receivers. The GPS navigation message comprises a 50 Hz signal that includes data bits that describe the GPS satellite orbits, clock corrections and other system parameters. Additional carriers, codes and signals are expected to be added to provide increased accuracy and integrity.

A system to provide even greater accuracy for GPS systems used in navigation applications is known as Wide Area Augmentation System (WAAS). WAAS is a system of satellites and ground stations that provide GPS signal correction to provide greater position accuracy. WAAS is comprised of approximately 25 ground reference stations that monitor GPS satellite data. Two master stations collect data from the reference stations and produce a GPS correction message. The correction message corrects for GPS satellite orbit and clock drift and for signal delays caused by the atmosphere and ionosphere. The corrected message is broadcast through one of the WAAS geostationary satellites and can be read by a WAAS-enabled GPS receiver. WAAS also provides information on the integrity of the WAAS-corrected GPS solutions. WAAS is designed with respect to certain fixed integrity levels in the area of position uncertainty for aircraft operational.

Some PGMs combine multiple types of guidance. For example, the Joint Direct Attack Munition (JDAM) uses GPS, but includes inertial guidance, which it uses to continue an engagement if the GPS signal becomes jammed.

A drawback associated with all these types of PGMs is the unintentional engagement of friendly or neutral targets. While LGBs have proven effective, a variety of factors such as sensor alignment, control system malfunction, smoke, dust, debris, and weather conditions can result in the LGB not hitting the desired target. SGMs may be confused by decoys. The image obtained by the SGM may be distorted by weather or battle conditions such as smoke and debris and result in the SGM not being able to lock onto the target. There are several areas where GPS errors can occur. Noise in the signals can cause GPS errors. Satellite clock errors, which are not corrected by the control station, can result in GPS errors. Ephemeris data errors can also occur. Tropospheric delays (due to changes in temperature, pressure and humidity associated with weather changes) can cause GPS errors. Ionospheric delays can cause errors. Multipath errors, caused by reflected signals from surfaces near the receiver that either interfere with or are mistaken for the signal, can also lead to GPS errors.

Despite the accuracy provided by LGBs, IGMs, SGMs, and GPR-based munitions, PGMs still occasionally inadvertently engage at or near friendly troops, sites, civilians or important collateral targets. This may be due to other factors as well, such as target position uncertainties, sensor errors, map registration errors and the like. This problem is increasingly important, both because domestic and world opinion is becoming increasingly sensitive to friendly fire and collateral damage, and because adversaries are more frequently deliberately placing legitimate military targets near neutral or friendly sites.

In a combat situation, it is difficult to target (i.e., designate) a weapon on unfriendly forces, without accidentally targeting nearby neutral or friendly elements (such as buildings, civilians, allied combat elements, or sister service combat elements, and elements of the same service).

SUMMARY OF THE INVENTION

A method of providing situational awareness and weapon targeting with integrity is presented. The method includes determining the location of one or more enemy locations and one or more protected locations. A "Do Not Engage" (DNE) zone is determined around each of the known or hypothesized protected locations, which can then be used to define an "Allowable Engagement" (AE) zone around each of the enemy sites, so that none of the AE zones overlap any of the DNE zones, but otherwise the AL zones are as large as possible. An engagement plan is then determined based on the DNE zones and the AE zones, wherein the engagement plan enables engagement of enemy sites within said AE zone, without engagement of the protected sites.

A system for providing situational awareness and weapon targeting is also presented. The system includes a processing and communications network performing intermediate processing of commands, reports and integrity data and a sensor element in communication with the processing and communications network. The sensor element may comprise any number of sensor subsystems. The sensor element receives tasking information from the processing and communications network and provides reports and integrity data to the processing and communications network. The system also includes a command control element in communication with the processing and communications network, the command control element receiving situational awareness information and integrity data from the processing and communications network and providing commands to the processing and communications network. The system further includes an operating elements section in communication with the processing and communications network, the operating elements section receiving commands and integrity data from the processing and communications network, and providing reports and integrity data to the processing and communications network. Certain embodiments of both the method and the system allows for dynamic selection of the desired integrity level by command and control.

BRIEF DESCRIPTION OF THE DRAWINGS

The invention will be more fully understood from the following detailed description taken in conjunction with the accompanying drawings, in which.

DETAILED DESCRIPTION OF THE INVENTION

Before describing the present invention, some introductory concepts and terminology are explained. An "aim-point" is the ideal target location that a munition is intended to engage. An "integrity bound" (also referred to as a "protection limit") defines a zone around a potential aim-point, within which the integrity of a miss can be assured to a corresponding probability level. That is, the munition should not engage outside the defined zone in order to meet a corresponding integrity level. The "integrity level" is the probability that the weapon will not engage outside its integrity bound. For example, a particular munition may have an integrity bound of 50 meters at an integrity level of 99.9%. This means that only one out of one-thousand munitions aimed at a target will engage more than 50 meters from the target. "Command and Control Personnel" are the human element of Command and Control ($C^2$), the operators of the system, and in the military doctrine are the persons authorized to command military actions. An "intended target" is some element, typically an enemy unit or infrastructure, that $C^2$ personnel or an automated $C^2$ unit wish to have engaged by a munition. A "protected target" is some element that $C^2$ personnel or an automated $C^2$ unit wish to not be engaged by munitions. Protected targets are typically friendly, allied, neutral or civilian units, systems, personnel or infrastructure elements.

The present invention provides a method and apparatus for performing integrity bound situational awareness and weapon targeting. More particularly, the present invention augments a traditional weapon targeting system with additional information that defines the confidence bounds and levels of that data, hereafter called "solution integrity" information. This solution integrity information is included with sensor observations and in automated inferences/calculations that are used in developing a weapon targeting plan for engaging intended targets while not engaging protected targets which may be located near the intended targets.

The targeting system is integrated with a situational awareness network, wherein functionality of the situational awareness network is expanded to provide solution integrity as part of the data used to make weapon targeting decisions, and to inform $C^2$. When targeting decisions are made, including target/aim-point selection and weapon allocation, the solution integrity of the desired target and nearby potential false targets (i.e., protected targets) are included as part of the targeting decision process. This is accomplished by setting an allowable integrity bound for an intended target based on the distance to the nearest false target.

Figure 1:
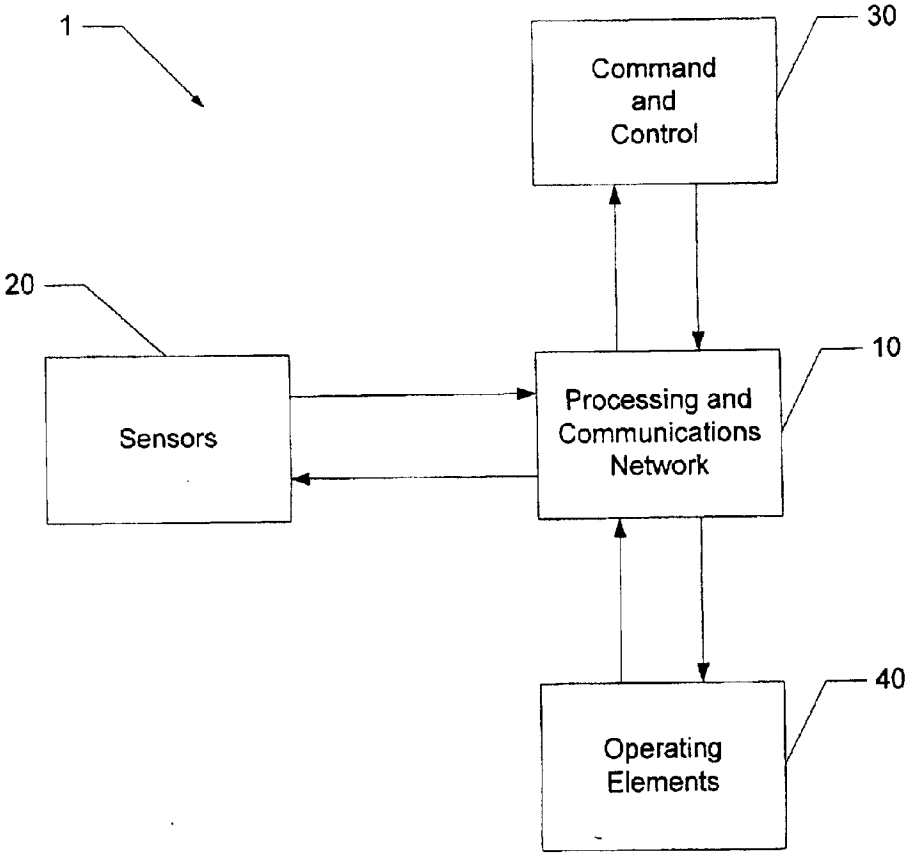
FIG. 1 is a block diagram of a system used for weapon targeting in accordance with the present invention.

Referring now to FIG. 1, a system 1 for providing integrity bound situational awareness and weapon targeting is shown. The system includes a processing and communications network 10 which is in communication with sensors 20, Command and Control ($C^2$) 30 and Operating Elements 40. Data used in determining weapon targeting is supplemented with integrity information to provide a weapon targeting plan which reduces or eliminates unintentional engagement of friendly sites.

The processing and communications network 10 summarizes and merges information from the sensors 20, operating elements 40 and command control 30. The processing and communications network 10 receives reports from the operating elements 40 and from the sensors 20 and provides situational awareness information to command control 30, as described in detail below. The processing and communications network 10 also receives commands from the command control 30 and forwards the commands to the sensors and operating elements 40.

Sensors 20 are used to detect the location of both candidate intended targets sites and protected targets. Sensors are also used to help determine the nature of targets. Sensors 20 may include, but are not limited to, soldiers with laser range finders, radar, vehicle sensors, lidar, sonar, passive acoustic devices, magnetic anomaly detectors, vibration sensors, passive optical sensors, passive infrared sensors, identify friend or foe (IFF) systems, position reporting systems, communications from allied forces, and humans filing reports.

The sensors 20 receive tasking information. This tasking information comprises either direct commands from $C^2$ or indirectly wherein $C^2$ issues a higher level command, and the processing and communications network 10 derives specific tasking information. The tasking information includes desired integrity levels and provides reports including solution integrity information. The tasking information may include any of the following information: search commands, Graphical Information System (GIS) information, input munition integrity performance, situational awareness information, targeting information, friendly unit locations, and potential collateral target locations. This information is supplemented with integrity information indicating modeled errors in the information, such as errors in the translation between different views as represented in the system. These potential errors and error calculation parameter values generated by specific information provided by the system are part of the solution integrity information.

Command and Control ($C^2$) 30 receives situational awareness data which comprises data on the locations and paths of friendly, allied, neutral and enemy elements. For high integrity operations this data can reflect that a particular area is empty of particular elements. The situational awareness data including integrity estimates is used by $C^2$ to generate commands. Integrity information on the situation is combined, refined, used for other calculations and displayed, and thus may be used by commanders and staff for many purposes. These commands provided by $C^2$ may include orders to commence with an engagement or to abort an engagement. The commands are integrated with the integrity status and are provided to the operating elements 40.

Operating Element (OE) 40 comprises the troops and equipment for carrying out the orders from $C^2$. The actions of the OE 40 are based on the integrity status. OE 40 also provides data to the processing and communications network including solution integrity values associated with the data. This data may include, for example, reports of enemy troop movement or the destruction of an intended enemy site.

The above-described system thus augments the traditional data used in weapon targeting decisions with integrity data. The data includes integrity modeling of data inputs including manual inputs, input databases, and error models of the sensors. This data is used to provide a basis for setting integrity thresholds on targets, and a resulting weapon targeting plan is developed which includes integrity data such that unintentional engagement of friendly sites is minimized or eliminated, while still providing precision engagement of enemy sites.

Figure 2:
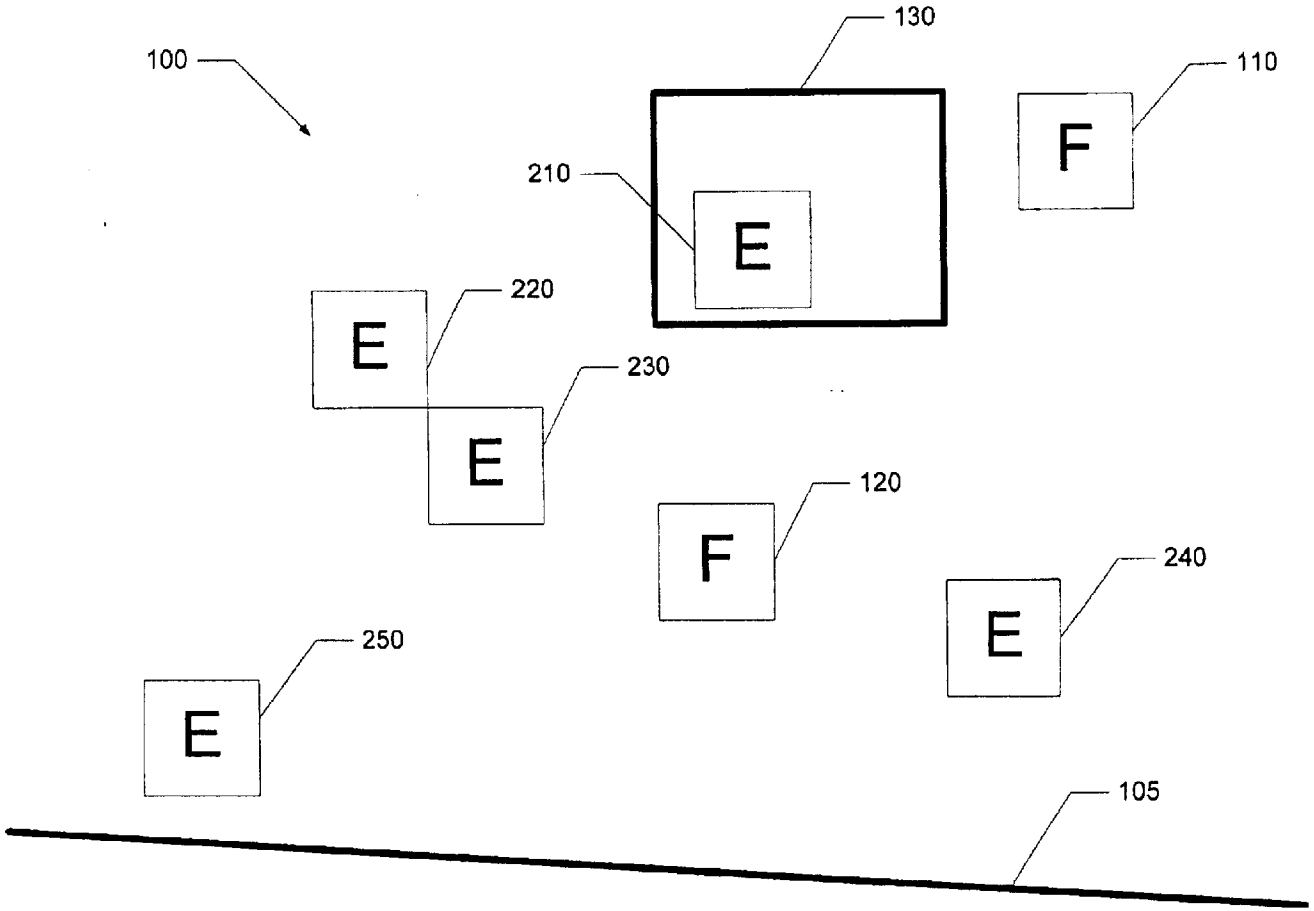
FIG. 2 is a block diagram of a battle zone showing friendly and enemy forces that can be generated by the system of FIG. 1.

The following scenario provides an example of integrity information that could be provided by systems incorporating the present invention. FIG. 2 illustrates an example combat situation 100. In this situation 100, there are two friendly squads (designated "F") 110 and 120 in the area, and four unfriendly or enemy squads (designated "E") 210, 220, 230 and 240 plus an unfriendly platoon (also designated "E") 250 in the area. There are also geographic features 105 which may have combat significance in themselves (e.g., hills, defensive walls, roads, etc.) and which can act as reference points to help a user orient between their real environment and a presented picture of that environment. Also shown is an establishment 130, having an enemy squad 210 located therein. Establishment 130 may be a building or other structure, and is used as a reference point and displayed to convey its intrinsic military significance.

Figure 3:
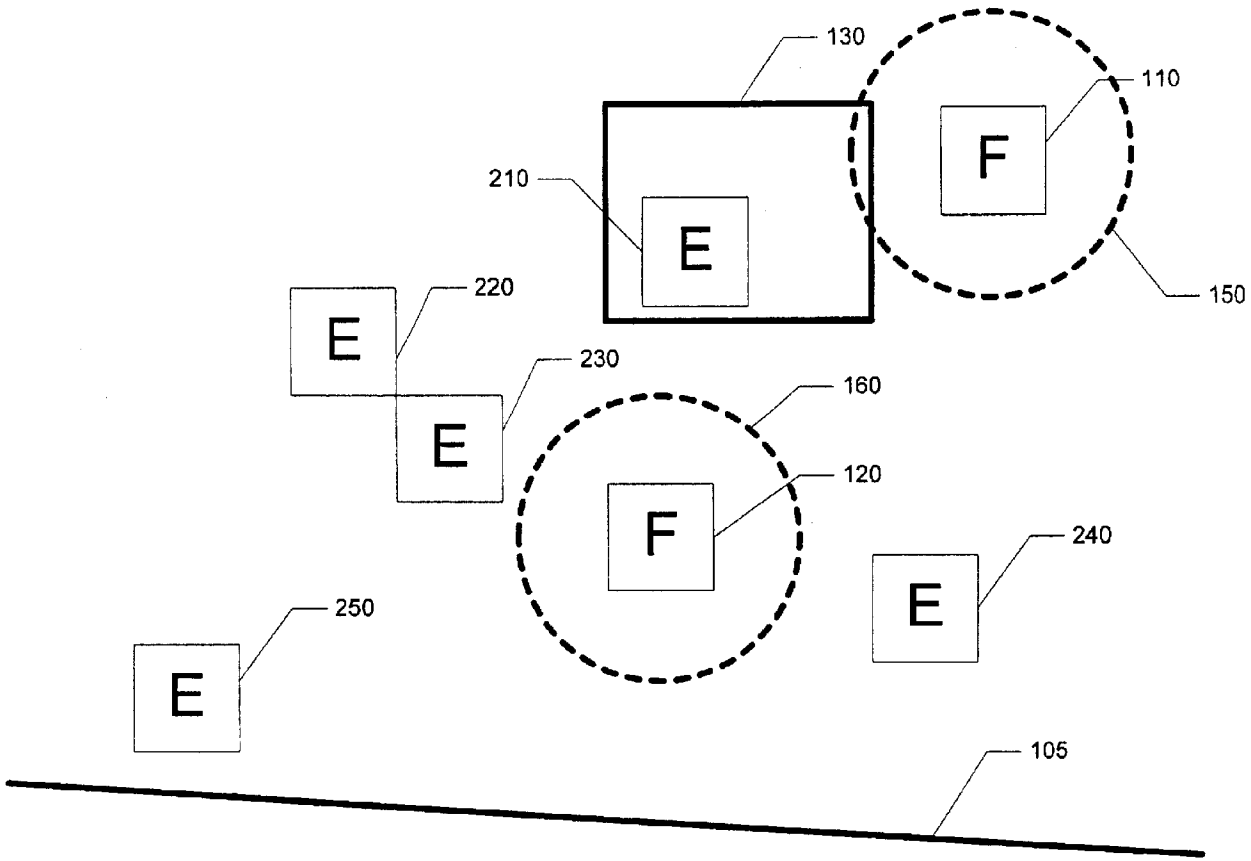
FIG. 3 comprises the block diagram of FIG. 2 with the addition of Do Not Engage zones.

FIG. 3 illustrates the combat situation of FIG. 2 with the addition of Do Not Engage zones 150 and 160 (also referred to as integrity bounds) around known friendly forces 110 and 120. These DNE zones are sized to illustrate the uncertainty in the position and dispersion of the indicated units, to a desired integrity level, and thus depend on the quality, timeliness, performance and state of the units' position reporting equipment and procedures. Indirect fire should not be called into the Do Not Engage zones 150 and 160, because the various instantaneous uncertainties (e.g., GPS position error, GPS to map registration error, potential unreported movement of indicated units) mean that an engagement within the Do Not Engage zones 150 and 160 may have some potential to adversely affect the friendly units 110 and 120. Similar Do Not Engage bounds could be placed around important potential collateral damage targets (e.g., hospitals, schools, places of religious worship). Other sites which could have Do Not Engage zones include friendly infrastructure (e.g., bridges, dams etc.), civilian population, civilian sites, and civilian infrastructure. For operations at high integrity levels, the existence of protected targets may only be hypothesized. Such hypothesized protected targets would have their own Do Not Engage zones.

The Do Not Engage zones are calculated based on mathematically combining the various uncertainties in the location of the protected targets. These uncertainties include unit dispersion, sensor uncertainties, map registration uncertainties, and the potential for movement of units over unreported time gaps. All of these error sources are calculated at their allocation of the selected integrity level (so that at a high integrity level, the uncertainties will be larger, and thus the DNE zone will be larger). The Allowable Engagement (AE) zone is that area outside the DNE zones.

Figure 4:
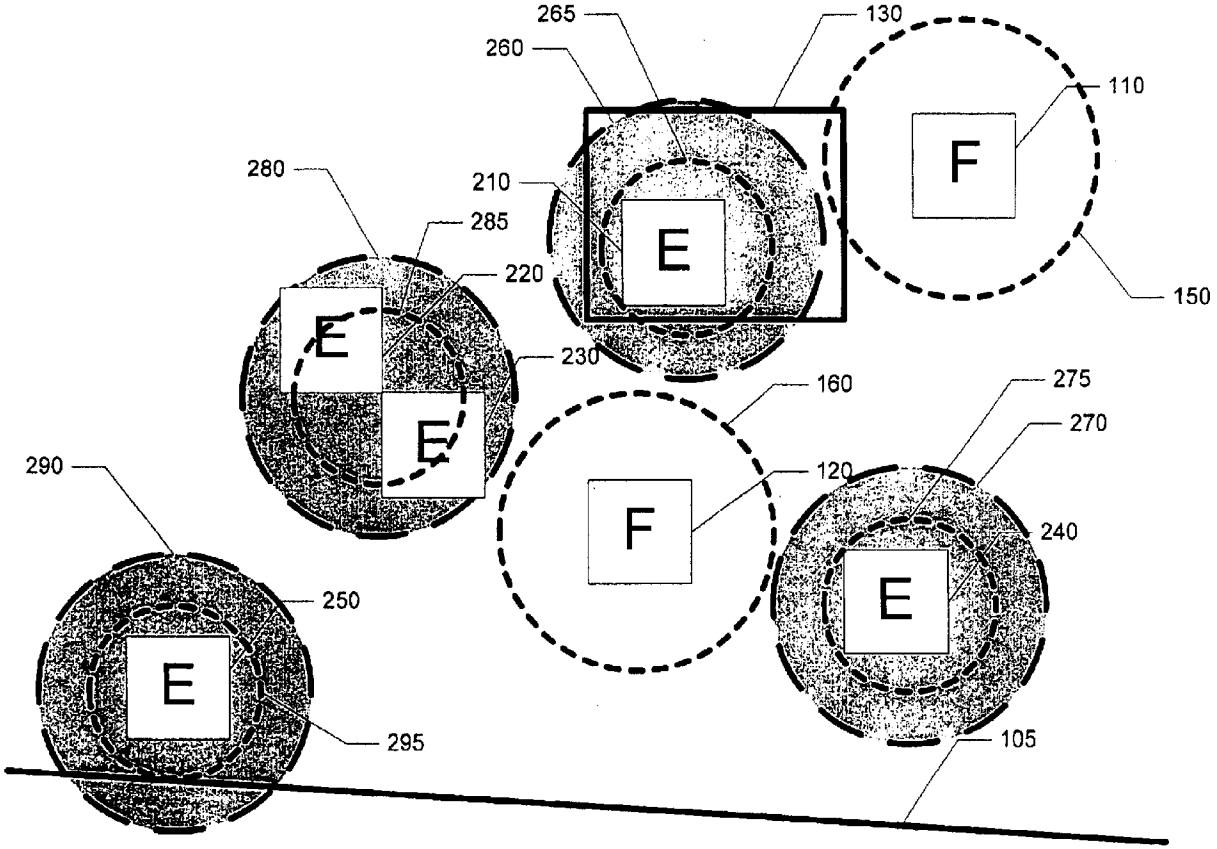
FIG. 4 comprises the block diagram of FIG. 3 with the addition of Allowable Engagement and Weapon Effect Zones.

Referring now to FIG. 4, a fire support plan has been added to the combat situation of FIG. 3. The fire support plan indicates calls for fire support in four areas, focused on the nearby enemy forces and shown by shaded "Integrity Bound Plus Weapon Effect" zones 260, 270, 280 and 290. These Integrity Bound Plus Weapon Effect zones (also referred to as uncertainty zones) are placed such that they do not overlap any of the Do Not Engage zones 150 and 160. Within that constraint, the Integrity Bound Plus Weapon Effect zones 260, 270, 280 and 290 are placed where possible to center their nominal aim point on the best estimated location of the indicated enemy units 210, 220, 230, 240 and 250. A single Integrity Bound Plus Weapon Effect zone may cover more than one enemy site as shown for Integrity Bound Plus Weapon Effect zone 280 which covers multiple enemy sites 220 and 230. By using this view to integrate an end-to-end view of expected integrity performance, indirect fire may be called close to friendly and potential collateral damage targets, while retaining confidence that these unintended targets will remain safe from the engagement. Fire Effect zones 265, 275, 285 and 295 may also be shown around the nominal aim-point of each Integrity Bound Plus Weapon Effect zone, to illustrate the likely overlap of weapon effect with enemy installations, enemy infrastructure, and civilian infrastructure being used by enemy troops.

The Integrity Bound Plus Weapon Effect zones are calculated using the sum of the alert limit plus the weapon effect distance. Depending on the implementation, the integrity bound on engagement scenario may be added in as well. The "Weapon Effect" (or "Fire Effect") zones 265, 275, 285, and 295 are calculated using standard modeling of munition payload effects on targets. The Integrity Bound Plus Weapon Effect zones will change whenever a different integrity level is used. The Integrity Bound Plus Weapon Effect zones will also be different for different munitions, for different engagement scenarios, and for different payloads.

Figure 5:
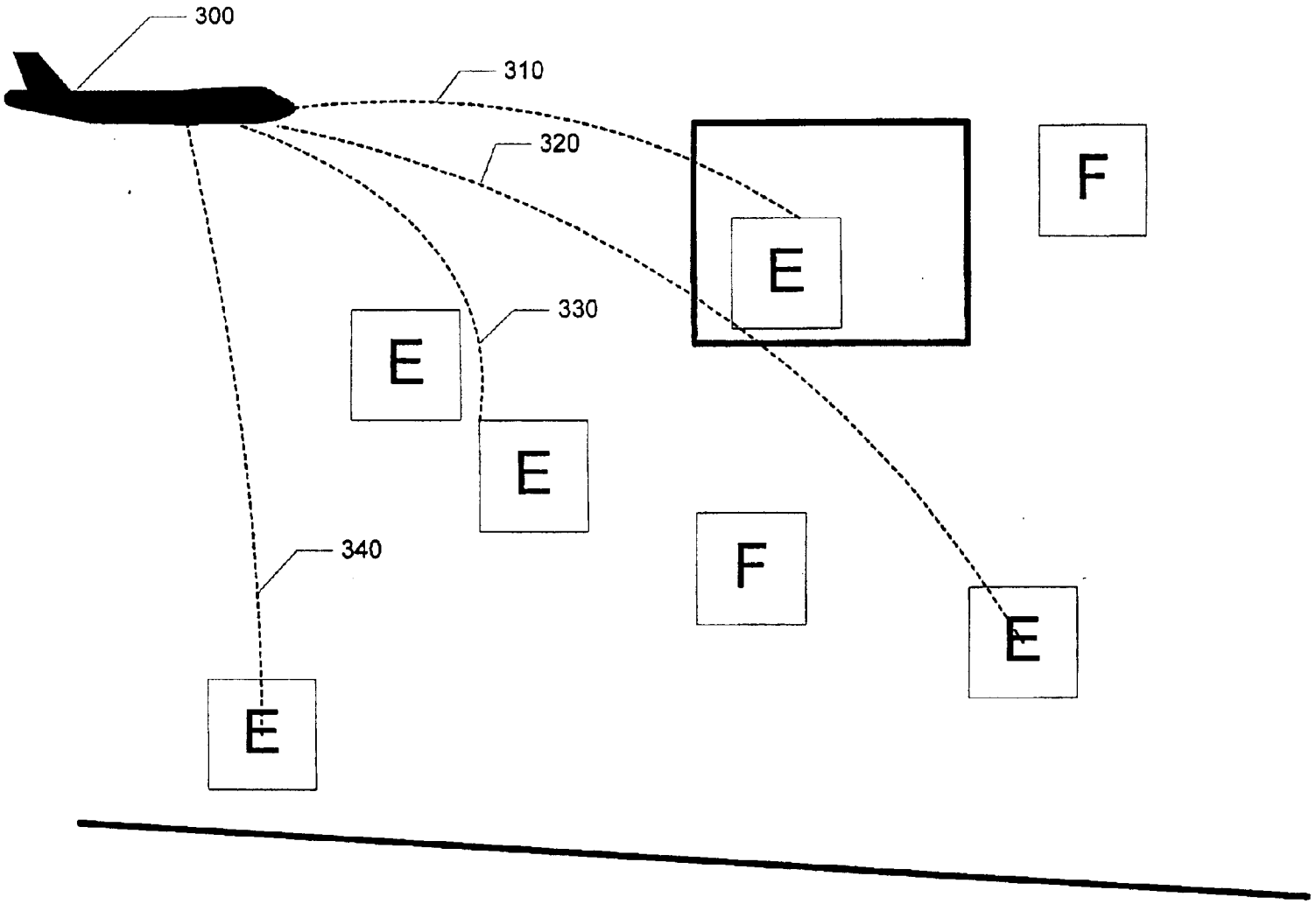
FIG. 5 comprises a block diagram of a battle zone showing precision engagement of a fire support plan in accordance with the present invention.

The fire support plan of FIG. 4 then allows an actual set of precision engagements with integrity, and is illustrated in FIG. 5. Fire support is delivered in this example by aircraft 300 launching PGMs along flight paths 310, 320, 330, and 340 without engaging the friendly squads 110 and 120. It should be noted that the flight path aim points are not necessarily centered on the enemy squads but rather on the center point of the Integrity Bound Plus Weapon Effect zones in order to ensure non-engagement of the friendly sites within the Do Not Engage zones. The friendly squad(s) are able to call in fire support that is closely intermixed with friendly forces, with confidence that this will not result in friendly fire. Being able to call in such fire improves the performance of friendly troops in combat.

The weapon engagement plan is developed using the Integrity Bound Plus Weapon Effect zones and the Do Not Engage zones. Users select aim-points, with the system tracking DNE zones, and alerting or refusing the operator on selection of an aim-point and munition that results in an Integrity Bound Plus Weapon Effect zones overlapping with a DNE (with both zones at the specified integrity level). If an automated weapon targeting system is used, then the DNE/Integrity Bound Plus Weapon Effect zones non-overlap becomes a constraint, or an evaluation factor, in the automated generation of the targeting plan. A goal of the targeting is ensuring that the intended "Weapon Effect" (or "Fire Effect") zones overlap the believed target locations. This can also result in putting a number of munitions in a dispersed pattern over a region where enemy forces are located.

Figure 6:
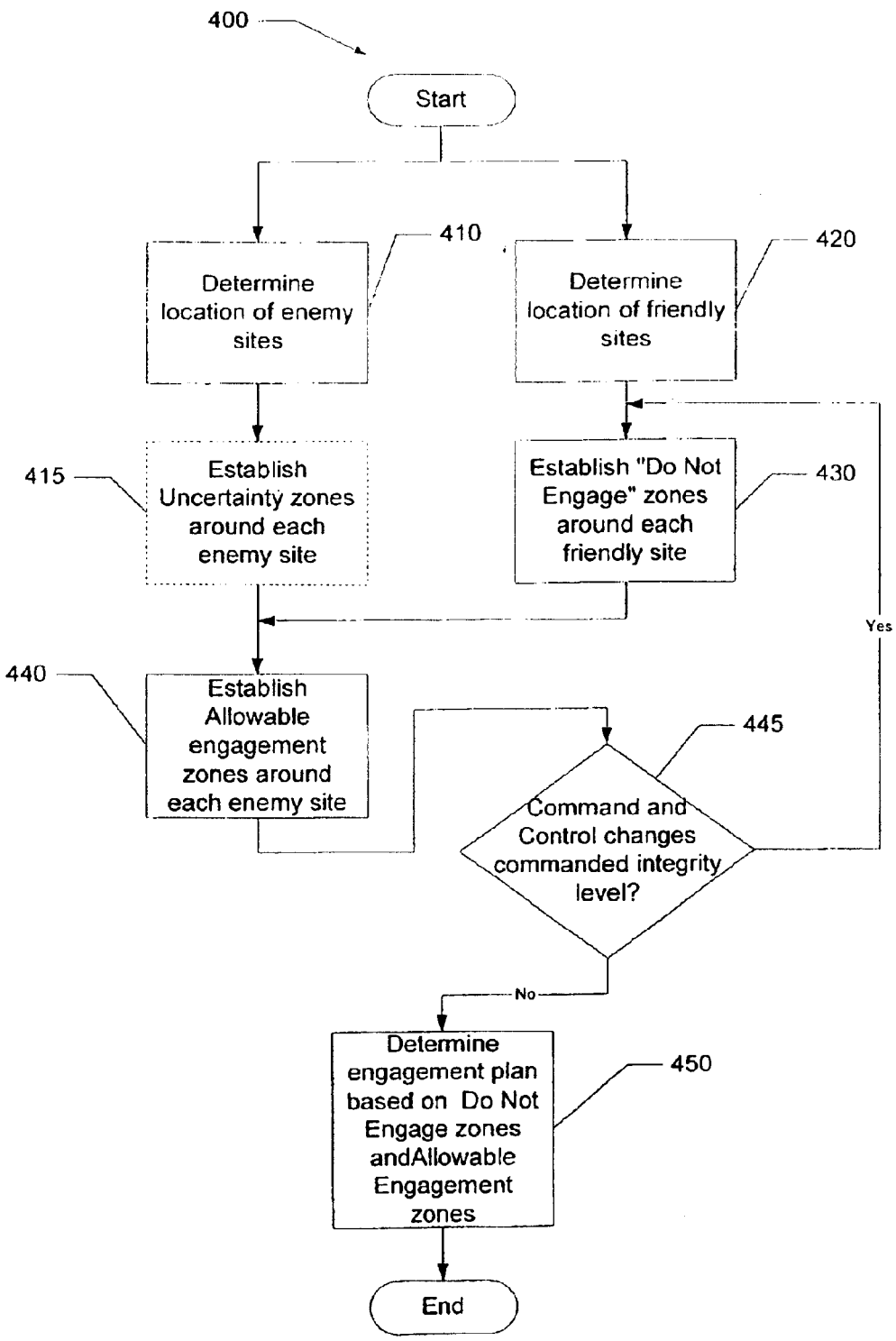
FIG. 6 is a flow diagram of a method for weapon targeting in accordance with the present invention.

A flow chart of the presently disclosed method is depicted in FIG. 6. The rectangular elements are herein denoted "processing blocks" and represent computer software instructions or groups of instructions. The diamond shaped elements, are herein denoted "decision blocks," represent computer software instructions, or groups of instructions which affect the execution of the computer software instructions represented by the processing blocks. Additionally, certain steps may be performed by an operator interacting with a computer display to select intended munitions and aim-points.

Alternatively, the processing and decision blocks represent steps performed by functionally equivalent circuits such as a digital signal processor circuit or an application specific integrated circuit (ASIC). The flow diagrams do not depict the syntax of any particular programming language. Rather, the flow diagrams illustrate the functional information one of ordinary skill in the art requires to fabricate circuits or to generate computer software to perform the processing required in accordance with the present invention. It should be noted that many routine program elements, such as initialization of loops and variables and the use of temporary variables are not shown. It will be appreciated by those of ordinary skill in the art that unless otherwise indicated herein, the particular sequence of steps described is illustrative only and can be varied without departing from the spirit of the invention. Thus, unless otherwise stated the steps described below are unordered meaning that, when possible, the steps can be performed in any convenient or desirable order.

Referring now to FIG. 6, a flow chart of the present method 400 is shown. The first step 410 is to determine the location of enemy sites. The enemy sites may include enemy troops, enemy installations, enemy equipment and the like. This is the ordinary function of existing situational awareness systems, and typically includes such things as radar observations, integrating tracks between multiple sensors, and folding in reported observations. Steps 410 and 415 may be performed in parallel with steps 420 and 430.

In step 415 the uncertainty zones are established around the enemy sites. These uncertainty zones define an area over which the enemy site may at a certain probability level be subject to effects from an engagement. These zones are determined in a manner similar to the Do Not Engage zones, except that data sources are much less certain. Therefore, this relies more heavily on the fusing of integrity data between observations by different sensors.

In step 440 the Allowable Engagement zones are established around the enemy sites. These Allowable Engagement zones define an area within which the enemy site may be targeting while still avoiding to a certain level the risk of engaging protected targets. These zones are determined by selecting the largest possible zone that does not overlap with any Do Not Engage zones.

In step 420 the location of protected sites is determined. The protected sites include friendly troops, friendly installations, equipment and the like. In some embodiments protected sites may also include civilian population and civilian sites. This is done primarily by reporting, but also includes sensor observations and Identify Friend-Foe (IFF) interrogations. For units it is likely to include some statement of deployed state, which implies potential unit dispersion.

In step 430 Do Not Engage zones are established around the protected sites. The Do Not Engage zones define an area wherein weapons must be assured not to hit within a certain integrity level. These Do Not Engage zones are determined by supplementing the position location of the friendly sites with the uncertainties in the position location.

In step 445, which is optional, a decision is made whether $C^2$ desires to change the commanded integrity level. When the decision is made to change the commanded integrity level, then steps 430 et seq. are executed. When the decision is not to change the commanded integrity level, then step 450 is executed.

In step 450 a weapon engagement plan is determined by $C^2$. The weapon engagement plan is based on the previously defined Do Not Engage zones and potentially the enemy uncertainty zones such that the weapons used are targeted to strike the enemy sites, while targeted to not strike within the Do Not Engage zones. By defining integrity thresholds on targets, the resulting weapon targeting plan is developed which includes integrity data such that unintentional engagement of friendly sites is minimized or eliminated, while still providing precision engagement of enemy sites. It may call for special munitions with smaller integrity bounds for key engagements, and will allow the use of less expensive munitions where larger Allowable Engagement zones provide room for larger integrity bounds.

Having described preferred embodiments of the invention it will now become apparent to those of ordinary skill in the art that other embodiments incorporating these concepts may be used. Additionally, the software included as part of the invention may be embodied in a computer program product that includes a computer useable medium. For example, such a computer usable medium can include a readable memory device, such as a hard drive device, a CD-ROM, a DVD-ROM, or a computer diskette, having computer readable program code segments stored thereon. The computer readable medium can also include a communications link, either optical, wired, or wireless, having program code segments carried thereon as digital or analog signals. Accordingly, it is submitted that that the invention should not be limited to the described embodiments but rather should be limited only by the spirit and scope of the appended claims. All publications and references cited herein are expressly incorporated herein by reference in their entirety.

What is claimed is:

1. A method of providing situational awareness in information and weapon targeting information comprising:

receiving a location of one or more enemy sites;

receiving a location of one or more protected sites;

establishing a Do Not Engage (DNE) zone around each of said protected sites; and determining an engagement plan based on said DNE zones and said enemy sites wherein said engagement plan enables engagement of enemy sites without impinging upon said DNE zones.

2. The method of claim 1 further comprising determining one or more hypothesized site locations based on situational awareness of one or more friendly, allied, neutral or civilian sites, said hypothesized sites considered as protected sites.

3. The method of claim 1 wherein said establishing a DNE zone comprises merging integrity data on the possible uncertainty and dispersion of the protected sites.

4. The method of claim 1 wherein said determining an engagement plan comprises:

selecting intended targets;

tracking said Do Not Engage zones at a predetermined integrity; and placing Integrity Bound Plus Weapon Effect zones around said intended targets such that none of said Integrity Bound Plus Weapon Effect zones overlap said Do Not Engage zones.

5. The method of claim 1 wherein said enemy sites include one or more of enemy troops, enemy installations, enemy infrastructure, and civilian infrastructure being used by said enemy troops.

6. The method of claim 1 wherein said friendly sites include one or more of friendly troops, friendly installations, friendly infrastructure civilian population, civilian sites, and civilian infrastructure.

7. The method of claim 6 wherein said friendly sites include one or more allied troops, allied installations or allied infrastructure, with allied integrity information provided indirectly through joint command channels.

8. The method of claim 6 wherein said friendly sites include at least one of the group consisting of civilian population, civilian sites, and civilian infrastructure, with civilian integrity information assessed independently by friendly sensors.

9. The method of claim 1 further comprising determining uncertainty zones around each of said enemy sites.

10. The method of claim 1 wherein said receiving a location of one or more enemy sites comprises receiving information from one or more of friendly units with fixed sensors and platform-based vehicle sensors.

11. The method of claim 10 wherein said sensors comprise one or more of radar, lidar, sonar, passive acoustic devices, magnetic anomaly detectors, vibration sensors, passive optical sensors, passive infrared sensors, and humans filing reports.

12. A system for providing situational awareness information and weapon targeting information comprising:

a processing and communications network processing commands, reports and integrity data; and a sensor element in communication with said processing and communications network, said sensor element receiving tasking information from said processing and communications network, and providing reports and integrity data to said processing and communications network; and a command and control element in communication with said processing and communications network, said command and control element receiving situational awareness information and integrity data from said processing and communications network and providing commands to said processing and communications network.

13. The system of claim 12 wherein said integrity data includes at least one of the group consisting of uncertainty estimating parameters for sensor observations, total integrity bounds for candidate munitions and engagement scenarios, uncertainty parameters at multiple integrity levels, uncertainty parameters selected to decompose as mathematical parameters that scale with dynamically selected integrity levels, and Do Not Engage (DNE) zones surrounding friendly sites.

14. The system of claim 13 wherein said command and control element selects the integrity level of each DNE from the available integrity levels.

15. The system of claim 13 wherein said command and control element selects the integrity level of each DNE from a continuously variable range.

16. The system of claim 13 wherein said command and control element determines an engagement plan based on said DNE zones and said total integrity bound wherein said engagement plan enables engagement of enemy sites without impinging upon said DNE zones.

17. The system of claim 13 wherein said DNE zone is determined by merging integrity data on the possible uncertainty and dispersion of the friendly sites.

18. The system of claim 13 wherein said engagement plan is determined by selecting aim-points, tracking said Do Not Engage zones at a predetermined integrity level with said aim-points, and placing Weapon Effect zones around said enemy sites such that none of said Weapon Effect zones overlap said Do Not Engage zones.

19. The system of claim 12 wherein said command and control element implements the function of commanding the system to operate at a selected integrity level.

20. The system of claim 12 wherein said command and control element implements the function of commanding the system to operate at a selected continuously variable integrity level.

21. The system of claim 12 wherein said integrity data includes Uncertainty zones surrounding said enemy sites.

22. The system of claim 12 wherein said enemy sites include one or more of enemy troops, enemy installations, enemy infrastructure, and civilian infrastructure being used by said enemy troops.

23. The system of claim 12 wherein said friendly sites include one or more of friendly troops, friendly installations, friendly infrastructure, civilian population, civilian sites, and civilian infrastructure.

24. The system of claim 12 wherein at least one of said friendly sites and said enemy sites include one or more hypothesized sites.

25. The system of claim 12 wherein said sensor element receives information from one or more of troops with range finders, vehicle sensors, radar, lidar, sonar, passive acoustic devices, magnetic anomaly detectors, vibration sensors, passive optical sensors, passive infrared sensors, and humans filing reports.

26. The system of claim 12 further comprising an operating elements section in communication with said processing and communications network, said operating elements section receiving commands and integrity data from said processing and communications network, said operating elements section providing reports and integrity data to said processing and communications network.

27. A method of providing situational awareness information comprising:

receiving a location of one or more enemy sites;

receiving a location of one or more friendly sites;

establishing Do Not Engage (DNE) zone around each of said friendly sites; and determining and engagement plan based on said DNE zones and said enemy sites wherein said engagement plan enables engagement of enemy sites without impinging upon said DNE zones.

28. The method of claim 27 further comprising establishing an uncertainty zone around each of said enemy sites.

29. The method of claim 27 further comprising displaying said DNE zones to command and control operators.

30. The method of claim 27 further comprising displaying said uncertainty zones to command and control operators.

* * * * *

UNITED STATES PATENT AND TRADEMARK OFFICE

CERTIFICATE OF CORRECTION

PATENT NO. : 6,952,001 B2
DATED : October 4, 2005
INVENTOR(S) : Thomas L. McKendree et al.

It is certified that error appears in the above-identified patent and that said Letters Patent is hereby corrected as shown below:

Column 1,
Line 5, delete "REAERENCE" and replace with -- REFERENCE --.
Line 9, delete "AEDERALLY" and replace with -- FEDERALLY --.

Column 4,
Line 47, delete "AL ZONES" and replace with -- AE ZONES --.

Column 10,
Line 45, delete "that that the" and replace with -- that the --.
Lines 52-53, delete "awareness in information" and replace with -- awareness information --.

Column 12,
Line 58, delete "determining and engagement" and replace with -- determining an engagement --.

Signed and Sealed this

Second Day of May, 2006

JON W. DUDAS
*Director of the United States Patent and Trademark Office*